US006152857A

United States Patent [19]

Gonzalez-Leal

[11] Patent Number: 6,152,857

[45] Date of Patent: Nov. 28, 2000

[54] APPARATUS FOR EXERCISING THE FACE AND NECK

[76] Inventor: Hector Aureliano Gonzalez-Leal, Roberto Garza Sada #146 Pte. Depto. C. Col. Balcones Del Valle 66220, Garza Garcia, Nuevo Leon, Mexico

[21] Appl. No.: 08/970,082

[22] Filed: Nov. 13, 1997

Related U.S. Application Data

[63] Continuation of application No. 08/761,426, Dec. 6, 1996, abandoned.

[51] Int. Cl.[7] ..... A63B 21/04; A63B 23/03; A63B 23/025

[52] U.S. Cl. ..... 482/10; 482/11; 482/129; 601/37; 601/39

[58] Field of Search ..... 482/10, 11, 12, 482/129, 130, 147, 47, 48; 601/38, 39, 147, 124, 37; 473/537, 538, 539, 540, 541, 542

[56] References Cited

U.S. PATENT DOCUMENTS

| | | | |
|---|---|---|---|
| 559,270 | 4/1896 | Edwards | 482/10 |
| 3,507,493 | 4/1970 | Robins | 482/11 |
| 3,507,494 | 4/1970 | Finkel | 473/526 |
| 4,066,259 | 1/1978 | Brentham | 482/10 |
| 4,291,871 | 9/1981 | Lippert | 482/46 |
| 4,537,393 | 8/1985 | Kusch | 482/10 |
| 4,666,148 | 5/1987 | Crawford | 482/11 |
| 4,750,734 | 6/1988 | Greenfield | 482/47 |
| 4,893,808 | 1/1990 | McIntyre | 482/10 X |
| 5,016,874 | 5/1991 | Boardman | 482/126 |
| 5,116,359 | 5/1992 | Moore | 482/10 X |
| 5,336,138 | 8/1994 | Arjawat | 482/10 |
| 5,386,991 | 2/1995 | Rochette | 473/540 |

OTHER PUBLICATIONS

World Sporting Goods Inc, Super Neck Developer (1979).

Power Web Exerciser, Best Priced Products, Inc. (Mar. 1, 1995).

*Primary Examiner*—John Mulcahy
*Assistant Examiner*—Victor K. Hwang
*Attorney, Agent, or Firm*—Breiner & Breiner

[57] ABSTRACT

Apparatus for exercising the face and neck comprises a frame with multiple perforations in its upper and lower parts for fastening flexible bands of various size and elasticity horizontally, vertical or at angles to produce elastic resistance fields for receiving a person's face to exercise facial muscles. Two ocular accessories with adjustable sockets are positioned within the frame on the flexible bands for exercise of the opening and closing of the eyelid. Support and fastening elements firmly retain the bands and accessories in place on the frame for exercising the facial muscles. A portable version of the apparatus provides handles for manually controlling the muscular pressure of the flexible bands on the facial and neck muscles.

7 Claims, 3 Drawing Sheets

1
1A
2
2A
2B
2C
3
3A
4
4A
5
5A
6
6A
7
8
8A
8B
8C
9
9A
9B
9C
9D
9E
9F
9G
9H
10
10A 1
1A
2
3
5
7
8
9
9A
9B
9C
9D
9E
9F 4
4A
4A

5A 5
5A
5A

6A 6
6A
6A 8B
8C

7

8A
8

1
1A
1A
2
2A
2B
2A
2B
3
3A
3A
4
5
6
8
9
9A
9B
9C
9D
9D
9E
9E
9F
9F
9G
9G
9H
9H

APPARATUS FOR EXERCISING THE FACE AND NECK

This application is a continuation of application Ser. No. 08/761,426, filed Dec. 6, 1996, now abandoned.

BACKGROUND OF THE INVENTION

The human being has muscle tissue underneath the skin in many parts of the body. Of special interest in the area of the face and neck there are located innumerable complex muscles beneath the skin; said muscles with age and without the appropriate exercise, begin the change their constitution from muscle tissue to fatty tissue, which causes a weak support to the external skin and an aging appearance, wrinkles, etc.

It is known that when muscles are exercised in a direct and regular manner, they begin to reshape thus molding the superficial skin. A typical example of this is the back area of the forearm, where with age in many people the skin begins to "hang", but when the person begins to exercise in regular ways specifically that body area, it begins to harden and the exterior skin contracts again as it joins the muscle tissue, giving a more youthful appearance to the skin, in addition to a shapely form.

Now, given the configuration of the face and neck, where there are complex muscle groups with very different shapes, it had been very difficult to invent an apparatus that could have enough versatility to exercise in a directed way those face muscles. Thus, one of the objects of this invention is to provide the necessary versatility to work the different muscle groups of the face and neck, so that the aged face or neck, with wrinkles, shapes again and the skin wrinkles disappear.

Another object is that the invention helps to shape the face in order to avoid plastic surgery, for improving its appearance, since the apparatus can be directed to very specific areas of the face or neck. In some cases, where certain areas need to be swollen, it is a matter of making exercises with more effort and in slow motion in order to swell the indicated area. On the other hand when certain areas need to be reduced, it is a matter of making the exercises with less effort and in fast motion in order to reduce it.

DESCRIPTION OF THE DRAWINGS

Characteristic details of this invention are clearly shown following description and in the drawings. Similar reference characters indicate similar parts throughout.

THE PREFERRED EMBODIMENT

Figure 1:
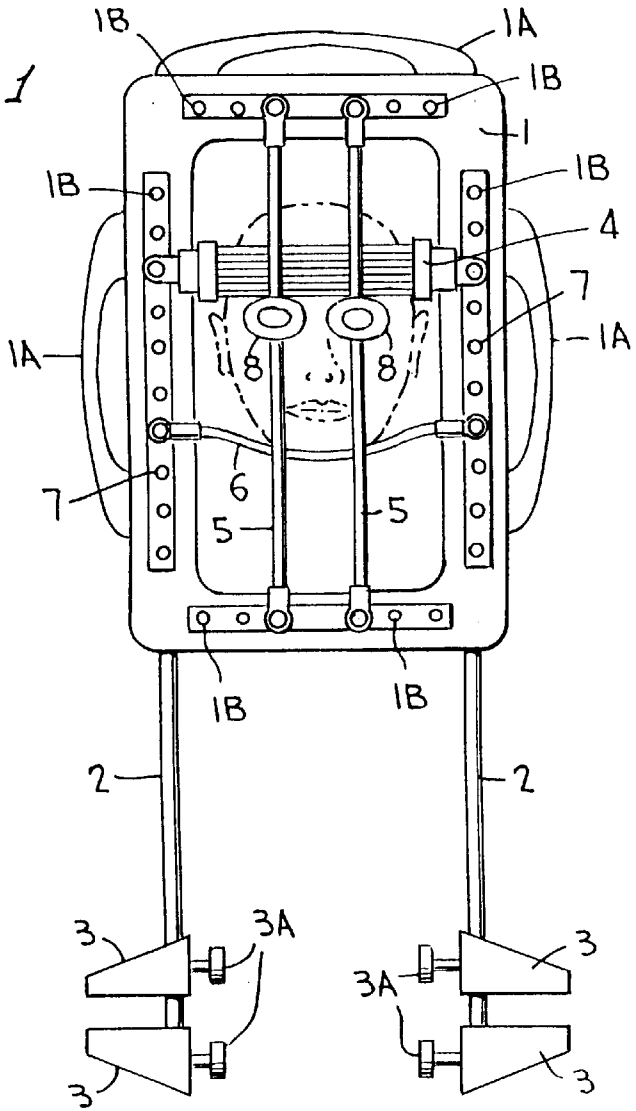
FIG. 1 is an elevation view showing the face exercising parts of the apparatus where the outline of the face of one person is in phantom view for comparison, wherein different accessories are place in one of the different ways in which they can be placed.

In reference to FIG. 1, this invention comprises in combination a main module consisting of one frame (1) which serves as the main multidirectional structure supporting the different accessories and illustrating four banks of perforations (1B). The top of the frame has six perforations for receiving bolts (7). The bottom of the frame has another six perforations (1B) for of receiving the bolts (7). The bolts (7) of the frame top are aligned with the bolts (7) of the frame bottom. On the left side then perforations (1B) are located in which the bolts (7) fit also in the same way. On the right side another bank of ten perforations (1B) is shown aligned with the perforations of the left side. This invention also contains three handles (1A) which serve as a support for the hands to exert a better pressure in specific exercises, without the need of the supports (2 and 9).

Figure 2:
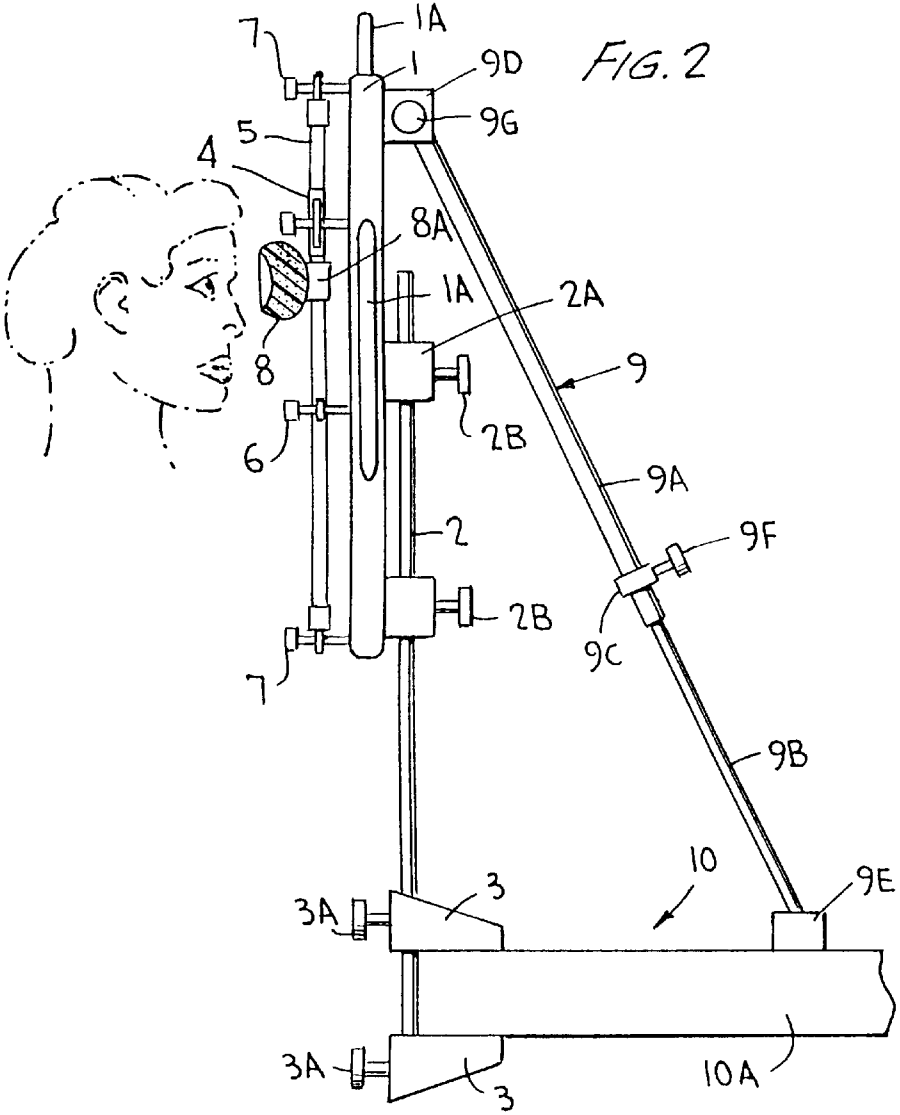
FIG. 2 is a side elevation view of the apparatus, with one person ready to begin the exercises.

As part of the invention, there may be two or more front supports (2), which allow the frame (1) to be installed over a table (10) (FIG. 2). These front supports (2) are fixed to the user side of the frames (1) opposite to the viewer by means of the fasteners (2A) which have one hole in which the upper ends of the front supports (2) are inserted to be secured by means of the frontmost screw clamps (2B). In their lower ends are clamps (3), by means of which the frame (1) is mounted on the edge of the table top (10A) of a table (10). For that purpose in each of the clamp (3) a screw clamp (3A) is inserted which secures the clamp (3) to the front support (2) by means of the insertion of the screw clamp (3A) in the rear end of the clamp (3).

Figure 4:
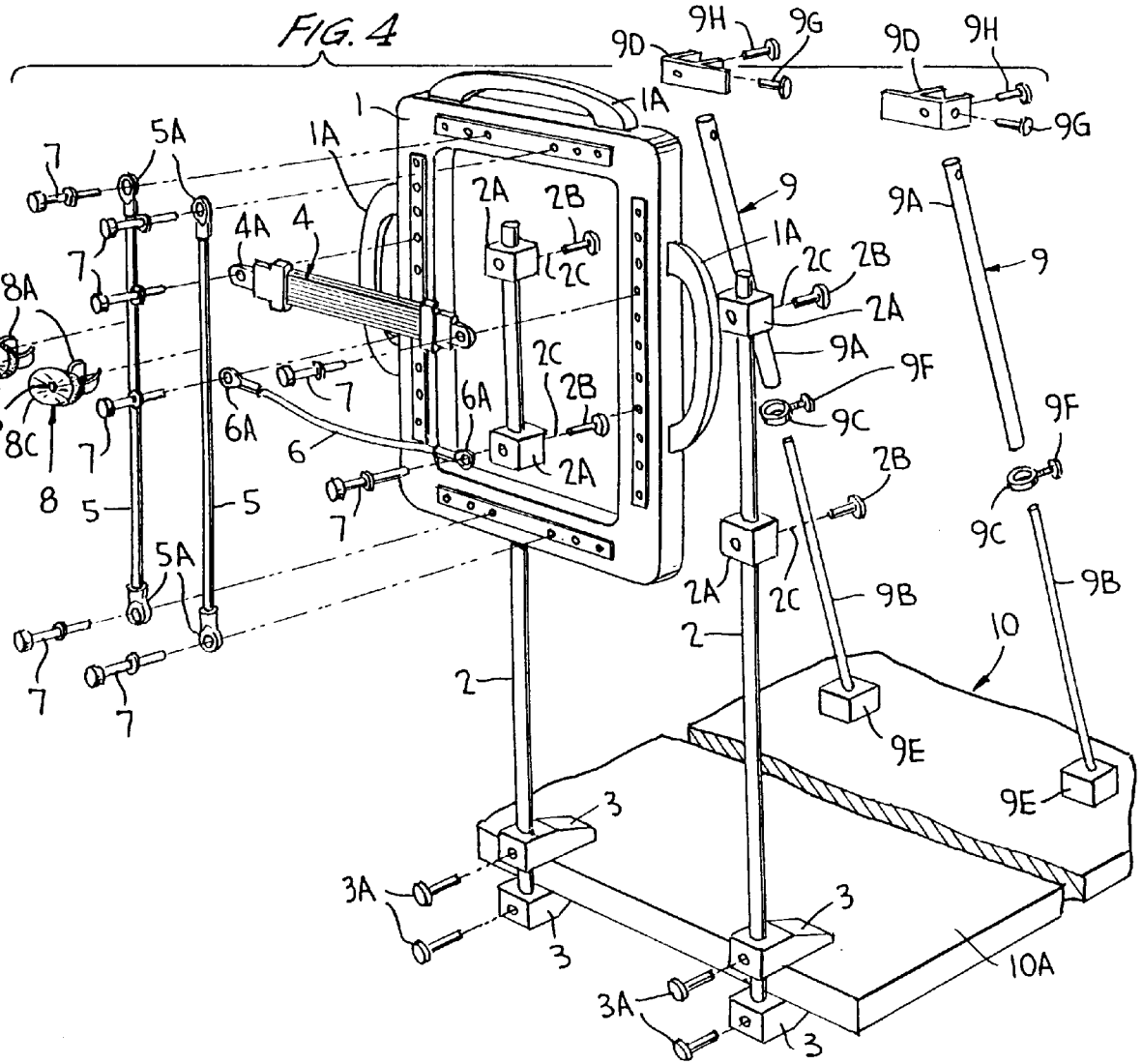
FIG. 4 is an exploded view of the apparatus, where different parts are illustrated.

An elastic band (4) is additionally illustrated serving as resistance to a specific area of the face to exercise that area. This figure is drawn to exercise the area of the forehead. The elastic band (4) has in its ends two terminals (4A) which serve to adjust the band (4) when more or less tension is required. Also the terminals (4A) fix the band (4) to the bolts (7). The thicker bands (5) which serve as resistance to certain muscles of the face or neck, have terminals (5A) (FIG. 4) in their ends which are used to fix the thicker bands (5) to the bolts (7) or to dismount the bands for adjustment when shorter sections of the bands are required to conform with the configuration of the face. The thinner bands (6) serve as resistance to certain muscles of the face (in this case exerting smaller resistance than thicker bands (5), said thinner bands (6) have on their ends terminals (6A) (FIG. 4) by means of which the thinner bands (6) are fixed to the bolts (7). These terminals can be dismounted with the thinner bands (6) to adjust theses when shorter sections of the bands are required to conform to the configuration of the face or neck. In FIG. 1 there are additionally illustrated bolts (7) which serve to connect the accessories to the frame (1) when a different angle for a specific exercise is required. Finally the ocular accessories (8) are illustrated which exercise the eyes' area, said accessories having on their back side a clip (8A) (FIG. 4).

Making a more detailed reference to FIG. 2, the frame (1) is illustrated from a side view, as well as the front support (2), the clamps (3), the way the clamps (3) are fixed to the table top (10A) and, the screw clamps (3A) and the way they are fixed to the front support. In said figure it is also observed, in side view, the band (4), the thicker band (5) and the thinner band (6), the bolts (7), and the way the bands are fixed to them; and the accessory for the eyes (8) and the way it is fixed with the clip (8A) to the thicker band (5). Also show is the back support (9) of the apparatus, which serves as a support for the frame (1) in its opposite the user side each time that pressure is exerted from the user's side. The telescopic elements (9A and 9B) are also observed which are incorporated one inside of the other. They permit the back support (9) to be shortened or lengthened as the position of the frame (1) requires. The ring (9C) is additionally illustrated, which together with the screw clamp (9F) fastens the telescopic elements (9A and 9B) together. The support (9D) fixes the upper end of the telescopic element (9A) to the support (9D) by means of the bolt (9G). Finally, the chock (9E) is shown serving as a protector between the base of the back support and the cover (10A) of the table (10), and to avoid sliding of the back support (9) backwards.

Figure 3:
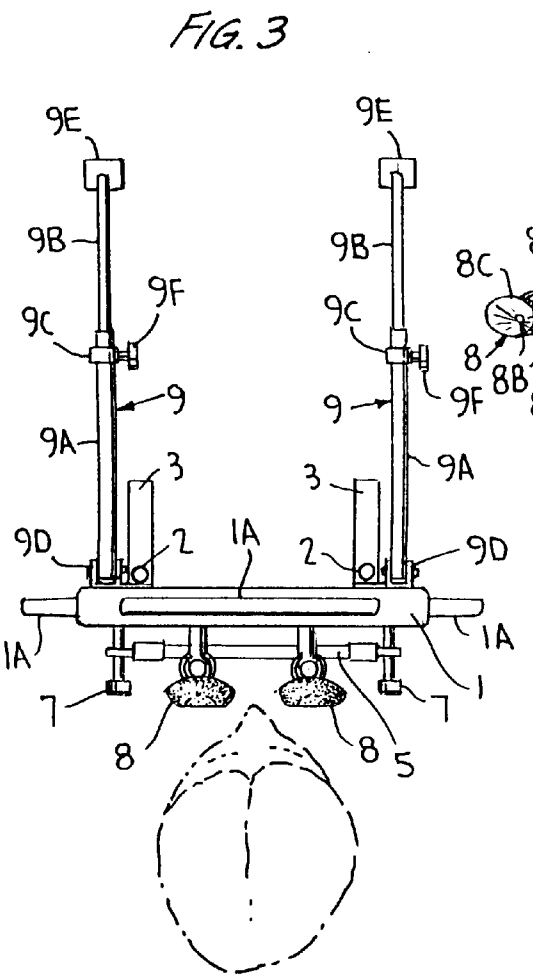
FIG. 3 is a top view illustrating the way the person is located in respect to the apparatus.
Figures 5, 6A, 6B, 6C, 6D, 6E, 6F, 6G, 6H:
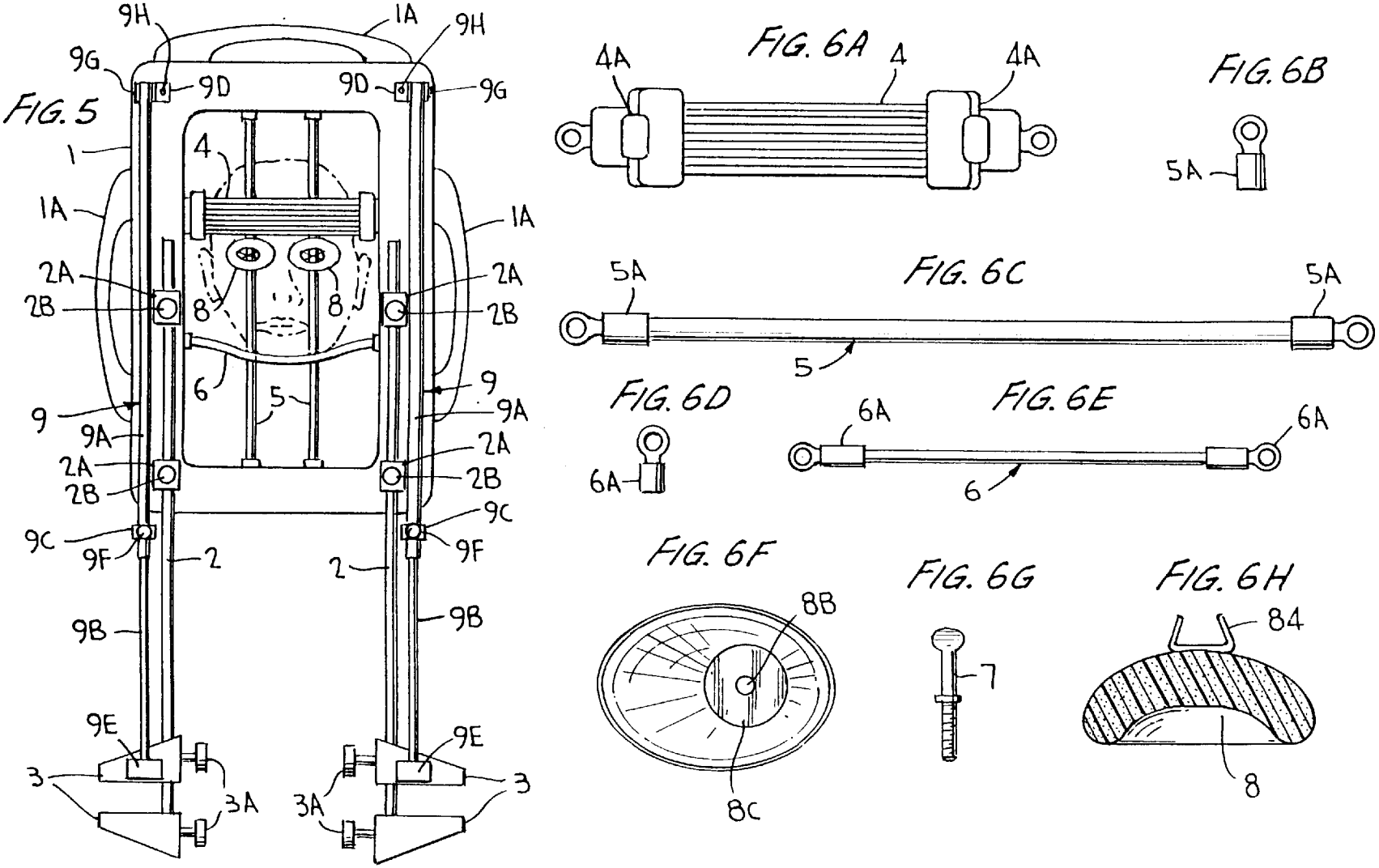
FIG. 5 is a working view of the apparatus looking into the face of an exercising person.
FIGS. 6A to 6H are views of the different accessories to be connected to the apparatus.

Reference to FIG. 3, the person is situated in relation to the apparatus. The lateral handles (1A), the upper side of the front supports (2), as well as the clamps (3), are seen from the top. The thicker bands (5) are additionally shown, as well as the bolts (7), the eyes' accessories (8), the telescopic elements (9A and 9B) which form the back support (9), the fixing rings (9C), as well as the screws (9F) and the supports (9D).

In FIGS. 6A to 6H the different accessories necessary to make the different types of exercises of the face are shown.

OPERATING METHOD

The thicker bands (5) can be fixed by means of their end terminals (5A) respectively to any one of the bolts (7), that is to say, they can be placed vertically, horizontally or even diagonally, with the object that they are in direct contact with the muscles which need to be exercised according to the case, by moving said muscles forcefully into the bands one may begin with the thinner bands (6) and as a greater muscular development is achieved they can be replaced by the thicker bands (5) and even by combinations of both.

This invention also provides accessories for the eyes (8), that by means of the clip (8A) are fixed to the bands in such a way that they are adjusted to stay in the region of the eyes, which, by being in contact with the accessory, can be exercised by closing and opening the eyelid to overcome the accessory's resistance. In this way the muscles are fortified with the repetitions of that exercise.

What is claimed is:

1. Face and neck exercising apparatus for exercising selected face and neck muscles of a person, the apparatus comprising:

means for framing a central aperture sized for receiving thereinto for exercising a person's face, chin and neck;

force resisting means comprising a plurality of flexible, elastic bands connected in at least one direction to extend across said central aperture in positions and with spacing to conform with the surface configuration of a person's face and neck muscles when the face is extended into said central aperture, said bands structured for intercepting facial, chin and neck skin for elastically resisting when the person's face, chin and neck are forcefully thrust into contact with the bands; and means for positioning the flexible bands on said framing means to create an elastic field for inserting in contact selected ones of the person's face, chin and neck muscles when the muscles are thrust into said central aperture into resisting contact with the bands, thereby reducing facial wrinkles by conditioning facial skin and muscles.

2. The apparatus of claim 1 further comprising:

a mixture of flexible bands of various thickness connected across the central aperture.

3. The apparatus of claim 1 further comprising:

means connecting said plurality of bands into both horizontally and vertically extending positions across the central aperture.

4. The apparatus of claim 1 further comprising:

hand grasping handles mounted upon said framing means for permitting the person to manually vary the pressure of the elastic bands against the face and neck muscles.

5. The apparatus of claim 1 further comprising elastic bands of various thicknesses for connection to the framing means for contacting selected face and neck muscles thereby to vary tension on different muscles thrust into contact with the respective elastic bands.

6. Face and neck exercising apparatus comprising in combination:

a framework extending about a central aperture of appropriate size for receiving a person's face and neck thereinto, means for selectively mounting a plurality of flexible bands to extend across said central aperture in position for intercepting a person's face and neck muscles when thrust into contact with the bands, means for positioning the flexible bands to create an elastic field for exerting pressure upon selected face and neck muscles when the face is thrust into contact with the bands, ocular accessories for mating with a person's eye region, and means for fastening said ocular accessories on said flexible bands for mating with a person's face in a position that the eyelid can open and close in order to strengthen the muscles surrounding the eye.

7. An exercise instrument for exercising muscle tissue in the face and neck to reduce aging appearance and facial wrinkles, the instrument comprising:

means for facial tissue engagement having a set of elastic cords supported in a surrounding framework in a pattern permitting entry of the face and neck into the framework between elastic cords in said set for facilitating exercising of muscle tissue for reducing wrinkles by elastic encounter of the elastic cords with selected surface areas of the muscle tissue about the face and neck disposed within the framework; and means for adjustably positioning the elastic cords in said framework to create individual facial and muscle exercising zones for selecting elastic encounter with particular muscle zones in the face and neck for exercise thereof by movement into elastic engagement with at least one of the elastic cords.

* * * * *